US012735147B1

(12) United States Patent
Farrell et al.

(10) Patent No.: US 12,735,147 B1
(45) Date of Patent: Sep. 15, 2026

(54) PONTOON BOATS AND METHODS AND APPARATUSES FOR ASSEMBLY AND DISSASSEMBLY OF PONTOON BOATS

(71) Applicant: Brunswick Corporation, Mettawa, IL (US)

(72) Inventors: Kevin T. Farrell, Port Orange, FL (US); Troy J. Kollmann, New Smyrna Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 273 days.

(21) Appl. No.: 18/742,382

(22) Filed: Jun. 13, 2024

(51) Int. Cl.

| | |
|---|---|
| ***B63B 3/08*** | (2006.01) |
| ***B63B 1/12*** | (2006.01) |
| ***B63B 35/34*** | (2006.01) |
| ***B63B 85/00*** | (2020.01) |

(52) U.S. Cl.
CPC ..... *B63B 3/08* (2013.01); *B63B 1/125* (2013.01); *B63B 35/34* (2013.01); *B63B 85/00* (2020.01); *B63B 2001/126* (2013.01); *B63B 2003/085* (2013.01)

(58) Field of Classification Search
CPC ..... B63B 3/08; B63B 85/00
See application file for complete search history.

(56) References Cited

U.S. PATENT DOCUMENTS

| | | | |
|---|---|---|---|
| 4,892,052 | A | 1/1990 | Zook |
| 6,302,042 | B1 | 10/2001 | Biedenweg |
| 9,937,983 | B1 | 4/2018 | Duke |

*Primary Examiner* — Timothy D Collins
(74) *Attorney, Agent, or Firm* — Andrus Intellectual Property Law, LLP

(57) ABSTRACT

A pontoon boat having a deck, a pontoon configured to float and thereby support the deck above a body of water, and a bracket assembly that couples the pontoon to the deck. The bracket assembly has a base bracket that is fixedly coupled to the deck and a hanger bracket that hangs the pontoon from the base bracket. The bracket assembly has a locked position in which the hanger bracket is fixed to the base bracket and an unlocked position in which the hanger bracket is slidable relative to the base bracket to facilitate removal of the pontoon from the deck.

20 Claims, 9 Drawing Sheets

PONTOON BOATS AND METHODS AND APPARATUSES FOR ASSEMBLY AND DISSASSEMBLY OF PONTOON BOATS

FIELD

The present disclosure relates to watercrafts, in particular to pontoon boats.

BACKGROUND

The following U.S. Patents are incorporated herein by reference in entirety.

U.S. Pat. No. 4,892,052 discloses a decking system for a boat including a deck substructure composed of aluminum cross members attachable on pontoons of the boat, and elongated aluminum deck planks being attachable to the cross members of the deck substructure in side-by-side relation to one another and there above to provide a deck platform upon the deck substructure.

U.S. Pat. No. 6,302,042 discloses a pontoon craft having at least two pontoons, a deck extending between two of the pontoons, an elongate deck support bracket attached to a pontoon and having a first longitudinal slot which extends substantially the entire length of the bracket, and a fastener extending through the first slot and having a variable position there along, wherein the deck is connected to the bracket by means of the fastener.

U.S. Pat. No. 9,937,983 discloses a pontoon boat including at least two pontoon tubes, a platform supported on the at least two pontoon tubes, and an occupancy compartment capable of containing at least one occupant, the occupancy compartment having a length, a width, an upper portion extending vertically above the platform that includes a ceiling, and a lower portion extending vertically below the platform and into one of the at least two pontoon tubes, the lower portion including a floor surface for supporting the occupant.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

In independent and non-limiting aspects disclosed herein, a pontoon boat comprises a deck, a pontoon configured to float and thereby support the deck above a body of water, and a bracket assembly that couples the pontoon to the deck. The bracket assembly comprises a base bracket that is fixedly coupled to the deck and a hanger bracket that hangs the pontoon from the base bracket. The bracket assembly has a locked position in which the hanger bracket is fixed to the base bracket and an unlocked position in which the hanger bracket is slidable relative to the base bracket to facilitate removal of the pontoon from the deck.

In independent aspects, the pontoon is elongated along a pontoon axis and in the unlocked position, the hanger bracket is slidable parallel to the pontoon axis.

In independent aspects, the base bracket comprises a supporting rail and the hanger bracket comprises a slide rail which is supported on the supporting rail. In the unlocked position, the slide rail is slidable along the supporting rail.

In independent aspects, the bracket assembly further comprises a locking fastener which fastens the hanger bracket to the base bracket in the locked position. The locking fastener may comprise a top fastener ramp and tightening the locking fastener causes the top fastener ramp to cam the hanger bracket into a stronger fixed coupling with the base bracket. The base bracket may comprise a supporting rail and the hanger bracket may comprise a slide rail which is supported on the supporting rail, wherein tightening the locking fastener cams the hanger bracket into a stronger fixed coupling with the base bracket. In certain aspects, the locking fastener comprises top fastener ramps that engage with corresponding ramps on the base bracket and the hanger bracket to cam the hanger bracket into said stronger fixed coupling.

In independent aspects, the bracket assembly further comprises a service tool that is attachable to the base bracket and/or hanger bracket, wherein attachment of the service tool to the base bracket and/or hanger bracket facilitates sliding of the hanger bracket relative to the base bracket in the unlocked position.

In independent aspects, attachment of the service tool to the bracket assembly lifts the hanger bracket relative to the base bracket to facilitate said sliding of the hanger bracket relative to the base bracket. The service tool may have a roller configured such that attachment of the service tool to the bracket assembly facilitates rolling of the hanger bracket relative to the base bracket along said roller. Attachment of the service tool to the bracket assembly causes the roller to lift the hanger bracket relative to the base bracket to facilitate said rolling of the hanger bracket relative to the base bracket along said roller. The service tool may comprise a body and a fastener configured to fasten the body to the base bracket, wherein tightening of the fastener lifts the body and the hanger bracket relative to the base bracket to facilitate said sliding of the hanger bracket relative to the base bracket.

In independent aspects, the service tool is one of a plurality of said service tools having a plurality of rollers configured such that attachment of the plurality of said service tools to the bracket assembly facilitates rolling of the hanger bracket along the plurality of rollers.

In independent and non-limiting aspects, a pontoon boat comprises a deck, a pontoon configured to float the deck above a body of water, and a bracket assembly that couples the pontoon to the deck. The bracket assembly comprises a base bracket that is fixedly coupled to the deck, a hanger bracket that hangs the pontoon from the base bracket, and a locking fastener having a locked position in which the hanger bracket is fixed to the base bracket and an unlocked position in which the hanger bracket is slidable relative to the base bracket to facilitate removal of the pontoon from the deck.

In independent aspects, a service tool is attachable to the bracket assembly, wherein attachment of the service tool to the bracket assembly facilitates sliding of the hanger bracket relative to the base bracket in the unlocked position. Attachment of the service tool to the bracket assembly lifts the hanger bracket relative to the base bracket to facilitate said sliding of the hanger bracket relative to the base bracket. The service tool may have a roller configured such that attachment of the service tool to the bracket assembly facilitates rolling of the hanger bracket relative to the base bracket along said roller.

In independent aspects, a method of removing the above-described pontoon from the pontoon boat comprises attaching the service tool to the bracket assembly and removing the pontoon from the deck by sliding the hanger bracket relative to the base bracket.

In independent and non-limiting aspects, an apparatus for coupling a pontoon to a deck of a pontoon boat comprises a base bracket that is fixedly coupled to the deck, a hanger bracket that hangs the pontoon from the base bracket, a locking fastener, and a service tool. The locking fastener has a locked position in which the hanger bracket is fixed to the base bracket and an unlocked position in which the hanger bracket is slidable relative to the base bracket to facilitate removal of the pontoon from the deck. The service tool is attachable to the bracket assembly, wherein attachment of the service tool to the bracket assembly facilitates sliding of the hanger bracket relative to the base bracket in the unlocked position.

BRIEF DESCRIPTION OF THE DRAWINGS

The present disclosure includes the following drawing figures. The same numbers are used throughout to reference like features and components.

DETAILED DESCRIPTION OF THE DRAWINGS

Figure 1:
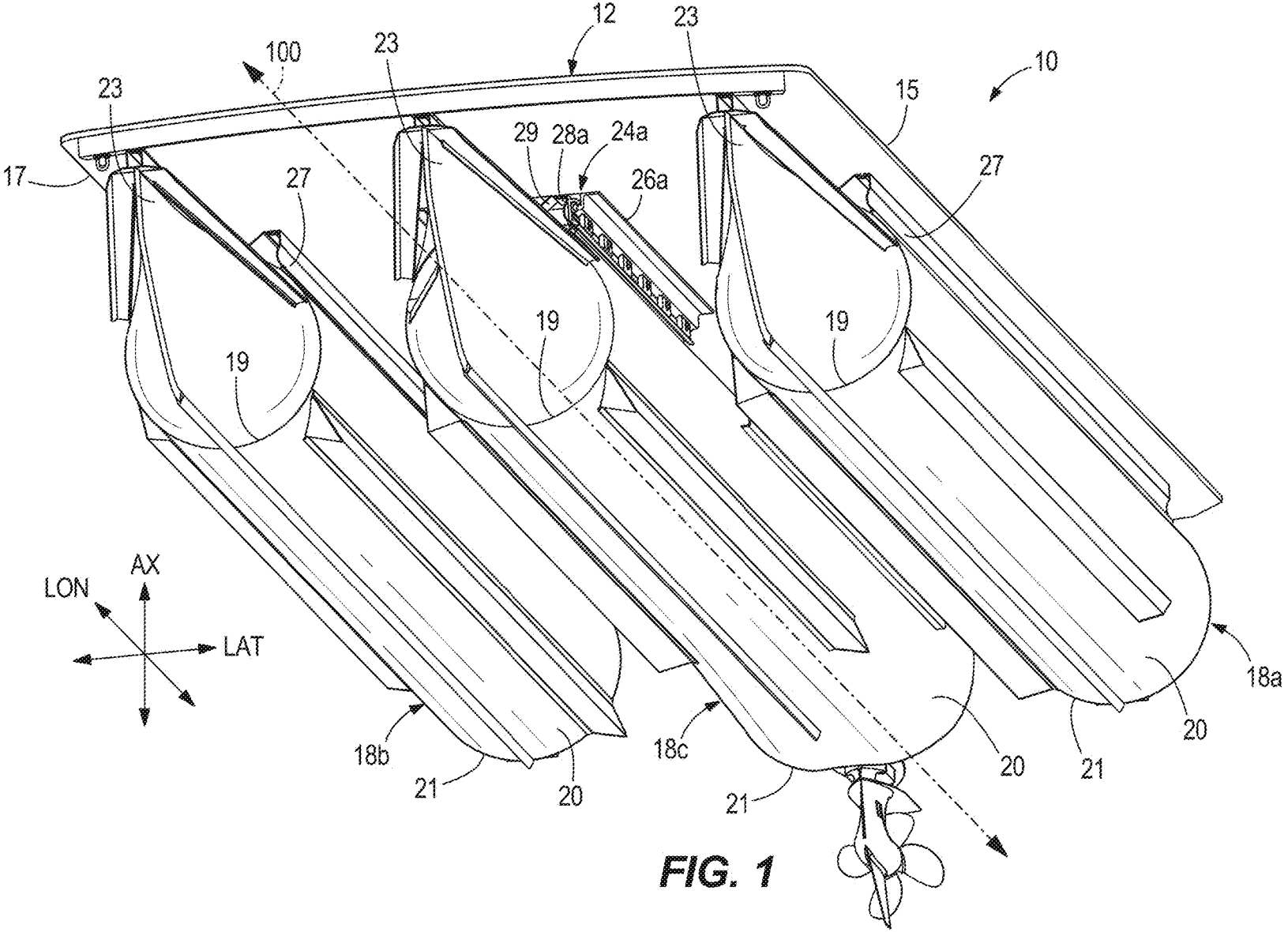
FIG. 1 is a perspective view of a pontoon boat having a deck and three pontoons coupled to the deck via an apparatus configured according to the present disclosure.

FIG. 1 is a perspective view looking up at a pontoon boat 10, having a deck 12 and three pontoons 18*a*, 18*b*, 18*c*. The pontoons 18*a*, 18*b*, 18*c* are configured to float and thereby together support the deck 12 above a body of water. The pontoon boat 10 extends from front to rear in a longitudinal direction LON, from a port side 15 to a starboard side 17 in a lateral direction LAT that is perpendicular to the longitudinal direction LON, and from top to bottom along an axial direction AX that is perpendicular to both the longitudinal direction LON and the lateral direction LAT. The deck 12 extends laterally and longitudinally and the pontoons 18 are located axially below and suspended from the deck 12 by a novel apparatus that will be further described herein below.

Figure 2:
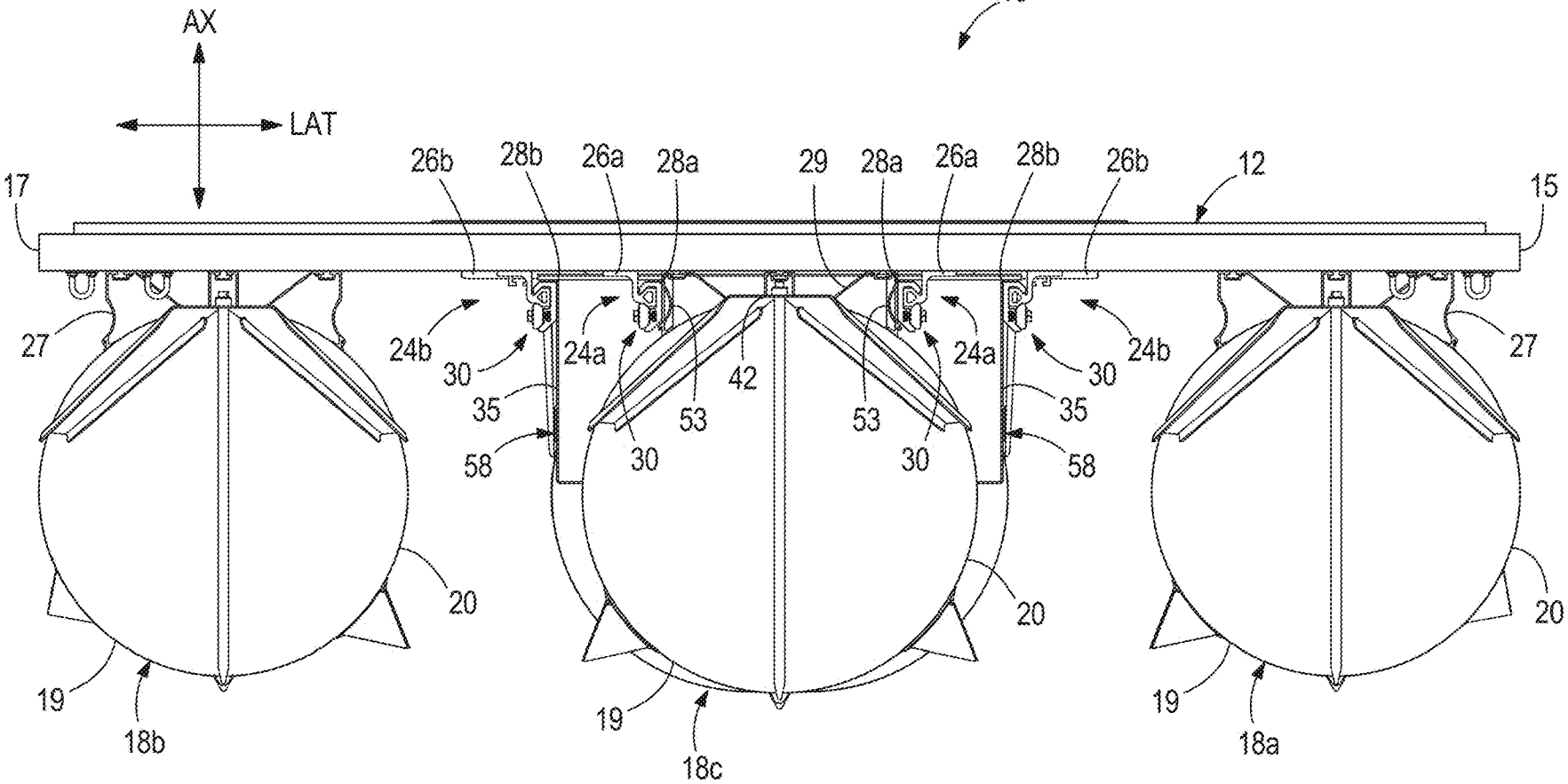
FIG. 2 is a front section view of the pontoon boat showing a bracket assembly configured according to the present disclosure for coupling a center pontoon to the deck.

Referring to FIGS. 1-2, the three pontoons 18*a*, 18*b*, 18*c* are laterally spaced apart and longitudinally extend beneath the deck 12. The number and configuration of the pontoons may vary from what is shown and described. In the illustrated example, the pontoons are arranged as a port pontoon 18*a*, a starboard pontoon 18*b*, and a center pontoon 18*c* that is laterally between the port and starboard pontoons 18*a*, 18*b*. Each pontoon 18*a*, 18*b*, 18*c* has a body 20 that longitudinally extends from a forward end 19 to a rearward end 21 along a pontoon axis 100, which in the figures is shown via dashed line only with respect to the center pontoon 18*c*. The bodies 20 of the port and starboard pontoons 18*a*, 18*b* have outer diameters that are generally cylindrical. The body 20 of the center pontoon 18*c* has an oblong or stadium-shaped cross-section when viewed in the longitudinal direction LON, with an outer diameter that tapers radially outwardly from an approximate midpoint 16 of the body 20 towards the rearward end 21. Each pontoon 18*a*, 18*b*, 18*c* has a nose cone 23 on its forward end 19 for reducing flow restriction as the pontoon boat 10 travels through the water.

Figure 3:
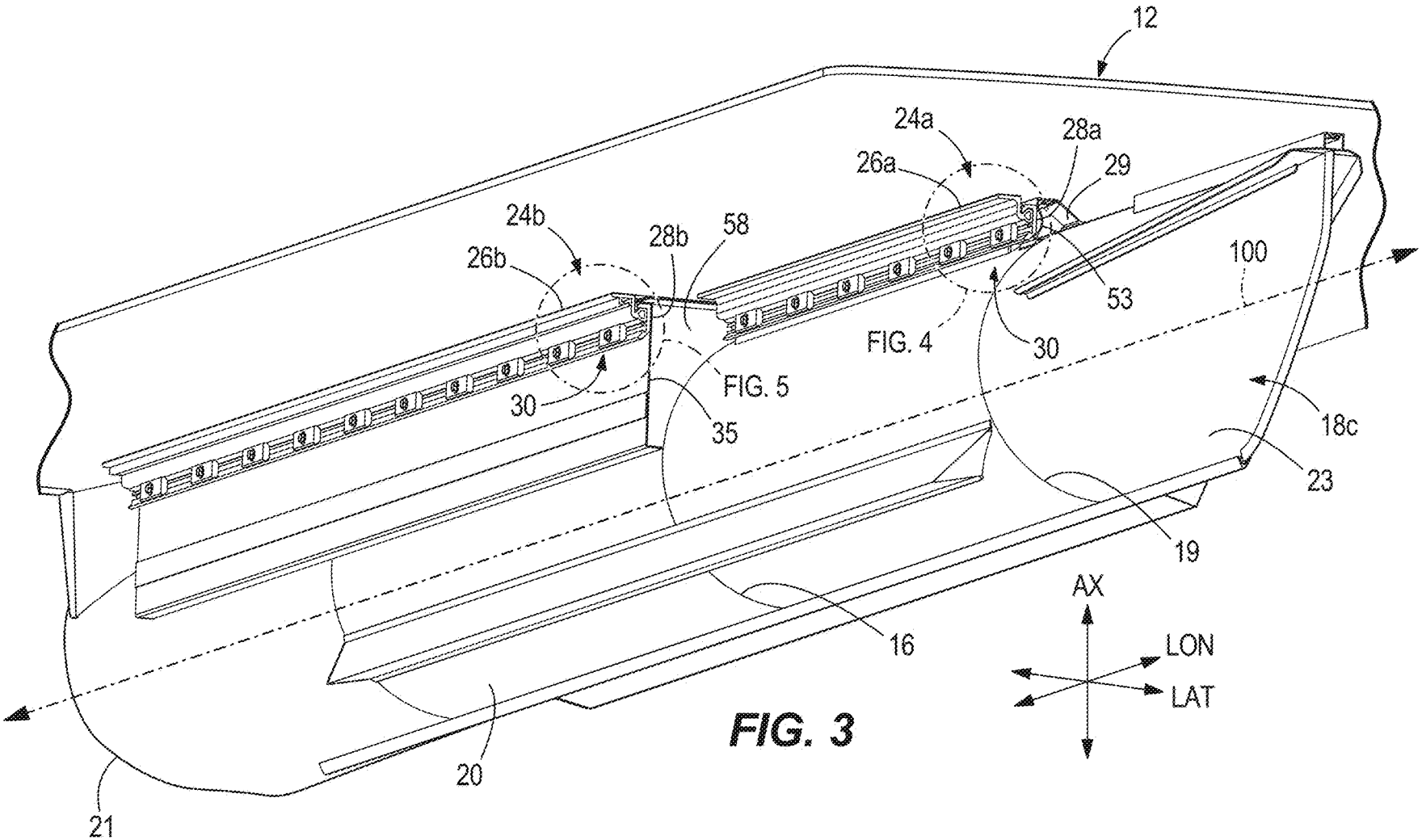
FIG. 3 is a view of the bracket assembly from beneath the deck.

Referring to FIGS. 2-3, the port and the starboard pontoons 18*a*, 18*b* are coupled to the deck 12 via a conventional bracket 27 having an M-shape when viewed in the longitudinal direction LON, as shown in FIG. 2. As will be described in greater detail below, the center pontoon 18*c* is coupled to the deck 12 via novel bracket assemblies 24*a*, 24*b*. In the illustrated example, a first bracket assembly 24*a* couples the center pontoon 18*c* to the deck 12 via an M-shaped bracket 29 located on top of the forward portion of the center pontoon 18*c*. The M-shaped bracket 29 is attached to the top of the body 20 and longitudinally extends at least forwardly of the midpoint 16. A second bracket assembly 24*b* couples the center pontoon 18*c* to the deck 12 via a pair of braces 58 on opposite sides of the rearward portion of the center pontoon 18*c*. The braces 58 are disposed on laterally opposite sides of the body 20 and extend rearwardly of the midpoint 16.

As shown in FIG. 2, each M-shaped bracket 29 has curved laterally outer sides 53 that are joined by an upper side 42. Referring to FIGS. 2 and 3, the braces 58 each have an outer side 35 which extends axially upwardly from an outer perimeter of the body 20. The braces 58 are secured to laterally opposite sides of the body 20 such that the outer side 35 extends generally perpendicularly to the deck 12.

During research and development, the present inventors identified a need for an improved bracket assembly for coupling pontoons to the deck of a pontoon boat that allows for efficient and effective removal of the pontoons from the deck for assembly, disassembly, servicing, and/or to allow for access to accessories stored therein. Known bracket assemblies for pontoons typically require a technician to remove fasteners and/or other portions of the bracket assembly to disengage the pontoon from the deck, while providing other means of support for the pontoon. The present disclosure is a result of the present inventors' efforts to provide improved bracket assemblies for pontoons that facilitate efficient coupling and decoupling from the deck. In certain aspects, the bracket assemblies herein provide efficient and effective access from outside of the attached pontoon such that an operator is able to couple and/or decouple the pontoon from the deck without requiring unnecessary deconstruction of the deck and/or the mounting assembly itself.

Referring to FIGS. 2-6, the first and second bracket assemblies 24*a*, 24*b* each couples the center pontoon 18*c* to the deck 12. In the illustrated embodiments, only the center pontoon 18*c* is coupled to the deck 12 via bracket assemblies 24*a*, 24*b*, although this is not limiting. It is conceivable that the port and/or the starboard pontoons 18*a*, 18*b* may also or alternately be mounted to the deck 12 via one or more bracket assemblies 24. It is also possible for the center pontoon 18*c* to be mounted to the deck by only one bracket assembly 24. The example pontoon boat 10 has a bracket assembly 24*a*, 24*b* which extends longitudinally on the port side 15 and a bracket assembly 24*a*, 24*b* which extends on the starboard side 17 of the center pontoon 18*c*. The respective bracket assemblies 24*a*, 24*b* on the port side 15 mirror the bracket assemblies 24*a*, 24*b* on the starboard side 17 and as such, the following description of the bracket assemblies 24*a*, 24*b* on the starboard side 17 should be understood to equally apply to the bracket assemblies 24*a*, 24*b* on the port side 15, respectively.

Figure 4:
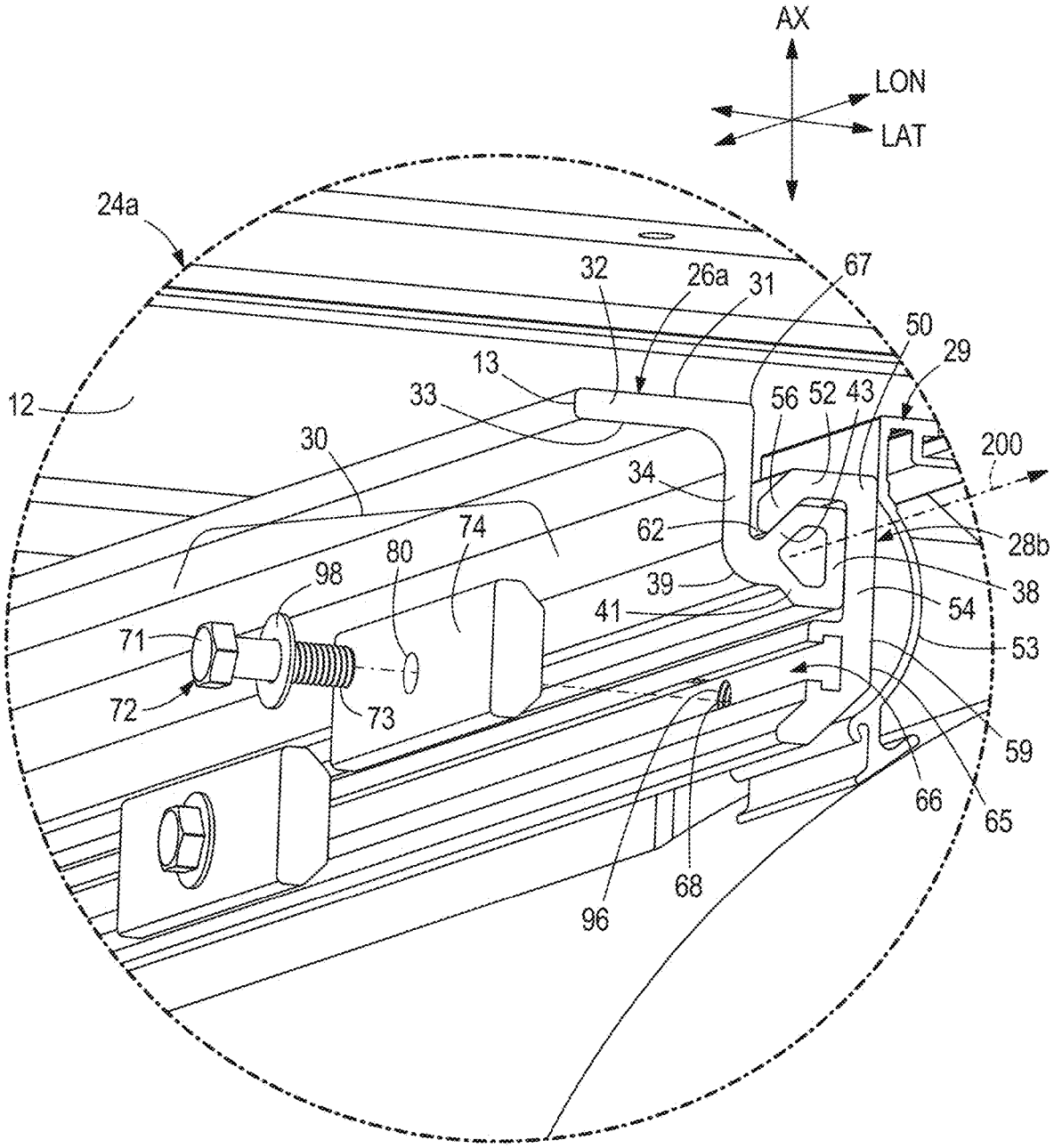
FIG. 4 is a detailed view taken in FIG. 3.
Figure 5:
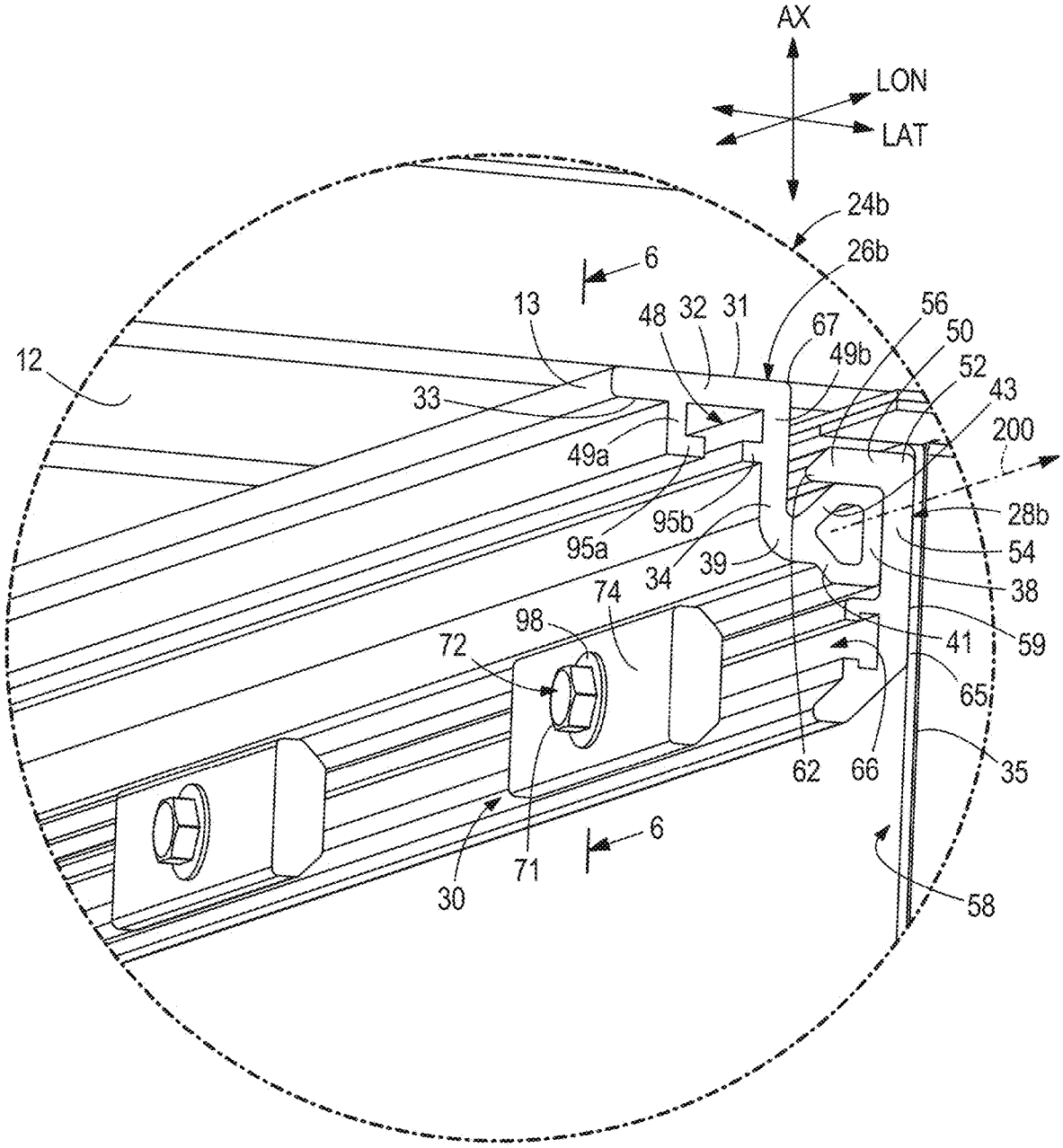
FIG. 5 is a detailed view taken in FIG. 3.
Figure 6:
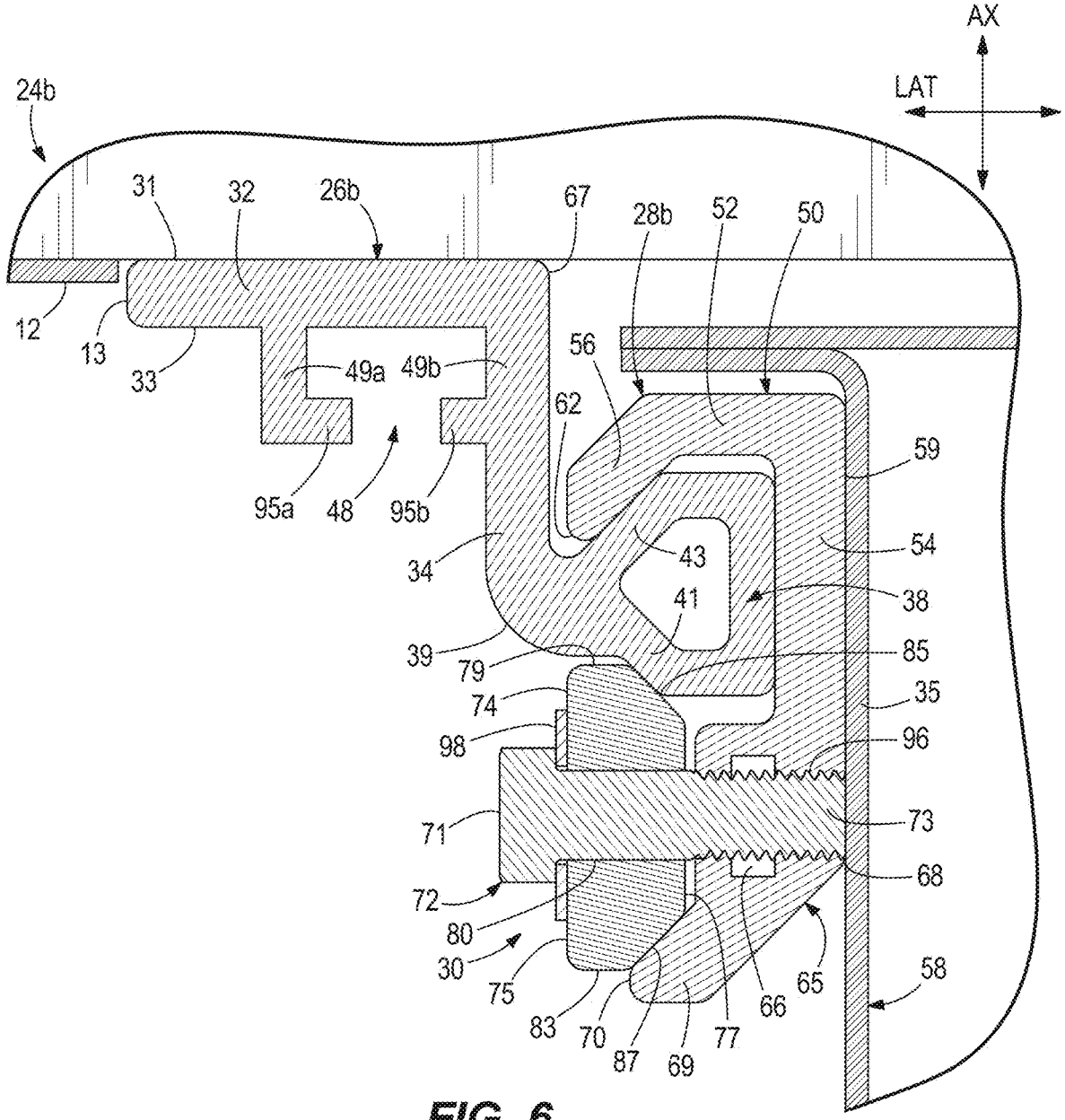
FIG. 6 is a view of section 6-6 taken in FIG. 5.

Referring now to FIGS. 4-6, each bracket assembly 24*a*, 24*b* includes a base bracket 26*a*, 26*b* and a hanger bracket 28*a*, 28*b* that longitudinally extends generally parallel to the pontoon axis 100. As further described herein below, the base bracket 26*a*, 26*b* is fixedly coupled to the deck 12. The hanger bracket 28*a* of the first bracket assembly 24*a* is fixedly coupled to the M-shaped bracket 29 (FIG. 4) and the hanger bracket 28*b* of the second bracket assembly 24*b* is fixedly coupled to the brace 58 (FIG. 5), and together are configured to hang the center pontoon 18*c* from the base bracket 26*a*, 26*b*. Each bracket assembly 24*a*, 24*b* further includes locking fasteners 30 which are longitudinally spaced apart and as further described herein below removably couple the hanger bracket 28*a*, 28*b* to the base bracket 26*a*, 26*b*.

Referring to FIGS. 4-6, each base bracket 26*a*, 26*b* includes a base 32 for coupling the base bracket 26 to the deck 12. The base 32 has an upper face 31 (FIG. 6) and a lower face 33 opposite the upper face 31. The upper face 31 is affixed to the deck 12. The base 32 laterally extends from a first end 13 to a second end 67 at which an arm 34 axially extends to an elbow 39. A supporting rail 38 laterally extends from the elbow 39. The supporting rail 38 has a trapezoidal cross-section when viewed along the longitudinal axis, as shown in FIG. 6. The supporting rail 38 has an upper ramp 43 which extends laterally and axially upward from the elbow 39, and a lower ramp 41 which extends laterally and axially downward from the elbow 39. The rearward base bracket 26*b* further includes a track 48. The track 48 extends longitudinally along the pontoon axis 100. The track 48 is defined by laterally opposing sidewalls 49*a*, 49*b* that extend axially downward from the lower face 33 toward lips 95*a*, 95*b* which converge laterally inward from either sidewall 49*a*, 49*b*.

Referring to FIGS. 5-6, each hanger bracket 28*a*, 28*b* has a slide rail portion 50 and an attachment portion 65. The slide rail portion 50 defines a slide axis 200 (FIG. 5) which extends generally parallel to the pontoon axis 100. The slide rail portion 50 has a sloped wall 56, a top wall 52, and a mounting wall 54. The sloped wall 56 extends at an angle axially upwardly and laterally from a first end 62 to the top wall 52. The top wall 52 laterally extends from the second end 63 to the mounting wall 54. The mounting wall 54 extends axially downwardly from the top wall 52 to the attachment portion 65. The mounting wall 54 has a mounting face 59 that faces the surface to which the hanger bracket 28*a*, 28*b* is mounted.

The attachment portion 65 has an elongated channel 66 defining a series of lateral through-bores 68. The through-bores 68 are spaced apart longitudinally along the channel 66 and each is configured for threaded engagement with one of the locking fasteners 30. For clarity, a description is provided herein below of one through-bore 68 and one corresponding locking fastener 30 which equally applies to all through-bores 68 and locking fasteners 30. The channel 66 is located on the mounting wall 54 below the slide rail portion 50 and opposite the mounting face 59, and the through-bore 68 extends through the mounting wall 54. The through-bore 68 has internal threads 96 for engaging the locking fastener 30. The attachment member 65 has an engagement ramp 69 which extends at an angle axially downward and laterally from the mounting wall 54 toward an outer end 70.

Referring to FIGS. 4-5, the hanger brackets 28*a*, 28*b* are coupled to the center pontoon 18*c* via the M-shaped bracket 29 and the braces 58, respectively. As shown in FIG. 4, the mounting face 59 of the mounting wall 54 of the forward hanger bracket 28*a* is affixed to the outer sides 53 of the M-shaped bracket 29. As shown in FIG. 5, the mounting face 59 of the mounting wall 54 of the rearward hanger bracket 28*b* is affixed to the outer side 35 of the brace 58.

As shown in FIGS. 3-5, the locking fasteners 30 are longitudinally spaced apart in alignment with the through-bores 68 of the hanger bracket 28. The locking fastener 30 has a threaded bolt 72, a washer 98, and a cleat 74.

Referring to FIG. 6, the cleat 74 has a first face 75 and a laterally opposed second face 77. The cleat 74 axially extends from a top face 79 to a bottom face 83. The cleat 74 further has a top fastener ramp 85 and a bottom fastener ramp 87. The first face 75 extends from the bottom face 83 to the top face 79. The top face 79 extends laterally between the first face 75 and the top fastener ramp 85. The top fastener ramp 85 extends between the top face 79 and the second face 77. The second face 77 extends between the top fastener ramp 85 and the bottom fastener ramp 87. The bottom fastener ramp 87 extends between the second face 77 and the bottom face 83. The bottom face 83 extends between the bottom fastener ramp 87 and the first face 75. The cleat 74 has a smooth through-bore 80 which extends laterally from the first face 76 to the second face 77.

The threaded bolt 72 has a head 71 and a threaded shaft 73. The washer 98 is disposed on the threaded shaft 73 between the head 71 and the cleat 74. The threaded shaft 73 extends through the washer 98, the through-bore 80 of the cleat 74, and the through-bore 68 of the attachment portion 65. This is example is not intended to be limiting. In other examples a square nut could be installed in the channel 66 in place of using the threaded bore 68.

In use, the bracket assembly 24*a*, 24*b* is movable into and between a supported position in which the center pontoon 18*c* is coupled to the deck 12 and an unsupported position in which the center pontoon 18*c* is removed from the deck 12. The bracket assembly 24*a*, 24*b* is movable into and between the supported and the unsupported position by sliding the center pontoon 18*c* relative to the deck 12 along the pontoon axis 100. The bracket assembly 24*a*, 24*b* further has a locked position (FIG. 6) in which the hanger bracket 28*a*, 28*b* is fixed to the base bracket 26*a*, 26*b* and an unlocked position in which the hanger bracket 28*a*, 28*b* is supported by but slidable relative to the base bracket 26*a*, 26*b* to facilitate removal of the center pontoon 18*c* from the deck 12. The bracket assembly 24*a*, 24*b* is movable into and between the locked position and the unlocked position via fastening and unfastening of the locking fasteners 30, which moves the locking fasteners 30 into and out of engagement with the base bracket 26*a*, 26*b*.

As shown in FIGS. 3-6, the base bracket 26*a*, 26*b* axially supports the hanger bracket 28*a*, 28*b* in the supported position, which hangs the center pontoon 18*c* on the deck 12. The supporting rail 38 extends along the slide axis 200 and the upper ramp 43 engages with the sloped wall 56 of the slide rail portion 50, such that the hanger bracket 28*a*, 28*b* is supported thereon. The locking fasteners 30 are engaged with the base bracket 26*a*, 26*b* in the locked position, which restricts sliding of the hanger bracket 28 relative to the base bracket 26. The top fastener ramp 85 of the cleat 74 is engaged with the lower ramp 41 of the supporting rail 38 and the bottom fastener ramp 87 is engaged with the engagement ramp 69 of the attachment portion 65. The threaded shaft 73 of the threaded bolt 72 extends through the through-bore 80 of the cleat 74 and engages with the internal threads 96 of the through-bore 68 of the attachment portion 65 to engage the cleat 74 securely with the base bracket 26*a*, 26*b*.

In use, to move the bracket assembly 24*a*, 24*b* from the locked position to the unlocked position, the locking fastener 30 is loosened to disengage the cleat 74 from the base bracket 26*a*, 26*b*. To loosen the locking fastener 30, the threaded bolt 72 is turned in a first direction, which moves the cleat 74 laterally outward from the attachment portion 65 such that the top fastener ramp 85 of the cleat 74 no longer engages the lower ramp 41 of the supporting rail 38. Once the cleat 74 no longer engages the base bracket 26*a*, 26*b*, the hanger bracket 28*a*, 28*b* is slidable along the slide axis 200 relative to the base bracket 26*a*, 26*b* such that the center pontoon 18*c* can be removed from the deck 12.

To move the bracket assembly 24*a*, 24*b* from the unlocked position to the locked position, the locking fasteners are tightened to engage the cleat 74 with the base bracket 26*a*, 26*b*. To tighten the locking fastener 30, the threaded bolt 72 is turned in a second direction, opposite the first direction. As the threaded bolt 72 is turned in the second direction, the cleat 74 moves toward the attachment portion 65 which moves the bottom fastener ramp 87 along the engagement ramp 69 until the top fastener ramp 85 engages with the lower ramp 41 and cams the hanger bracket 28*a*, 28*b* into a fixed coupling with the base bracket 26*a*, 26*b*.

Figure 7:
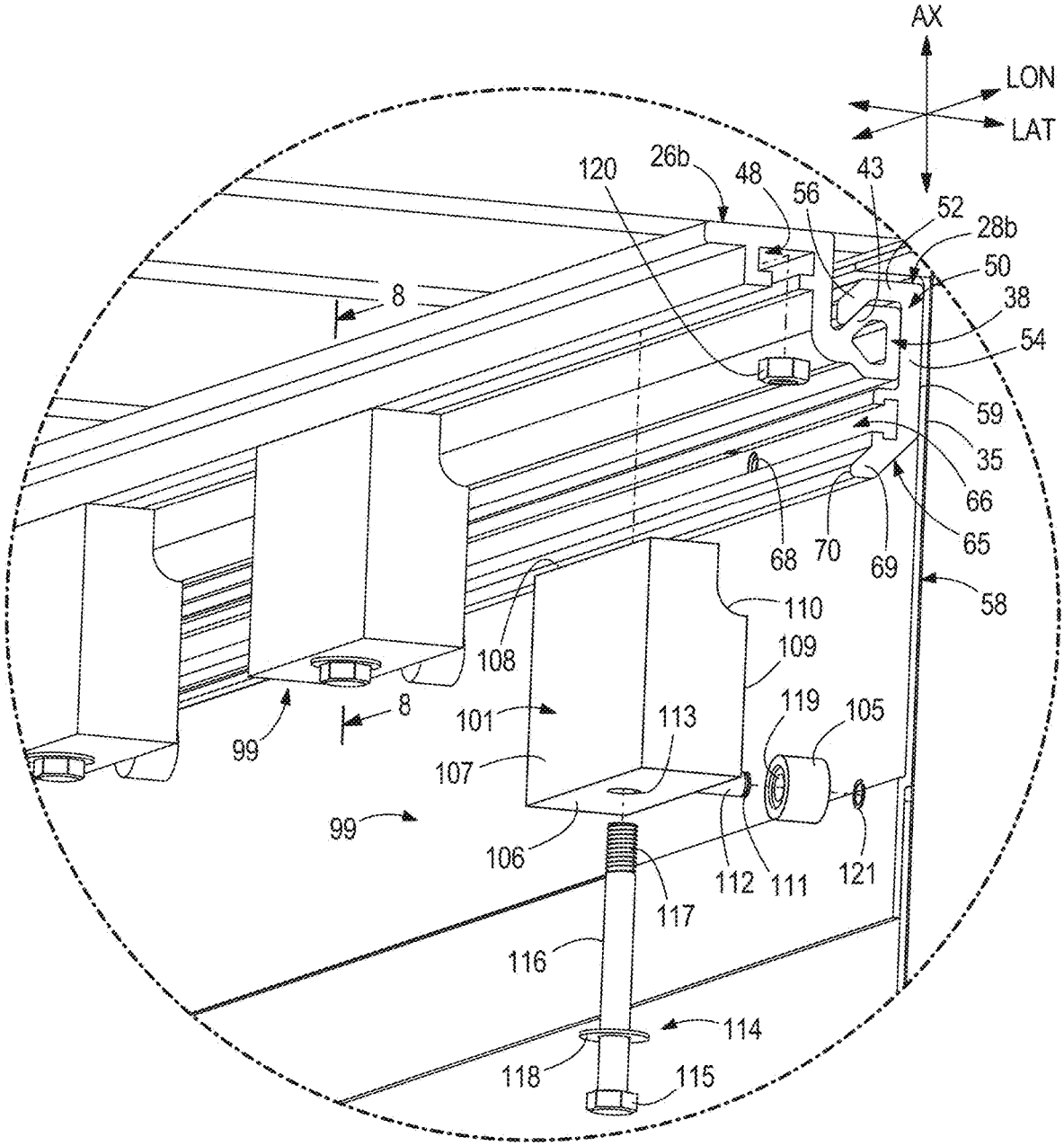
FIG. 7 is a view of the bracket assembly and a removal tool of the bracket assembly configured according to the present disclosure.
Figure 8:
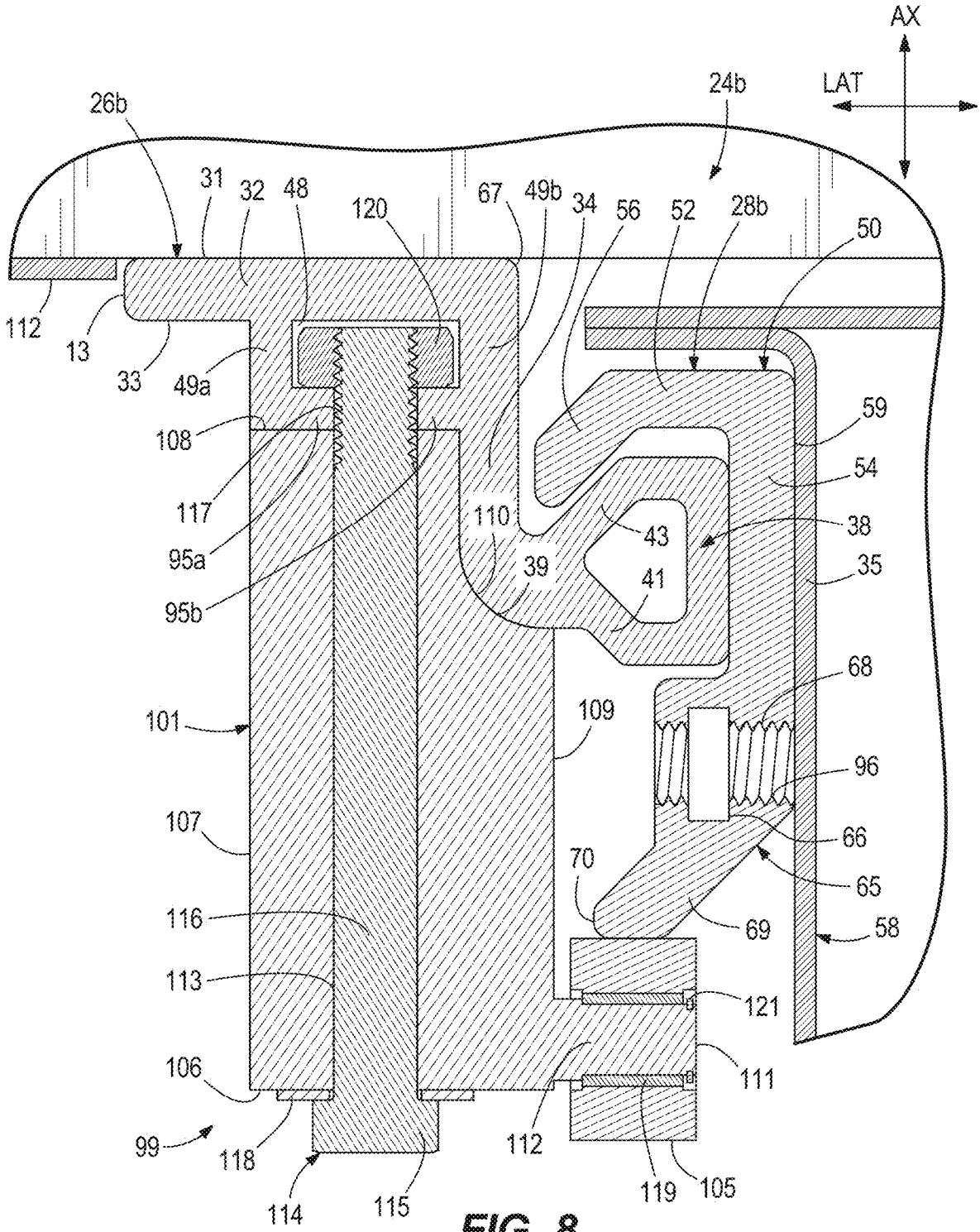
FIG. 8 is a view of section 8-8 taken in FIG. 7.
Figure 9:
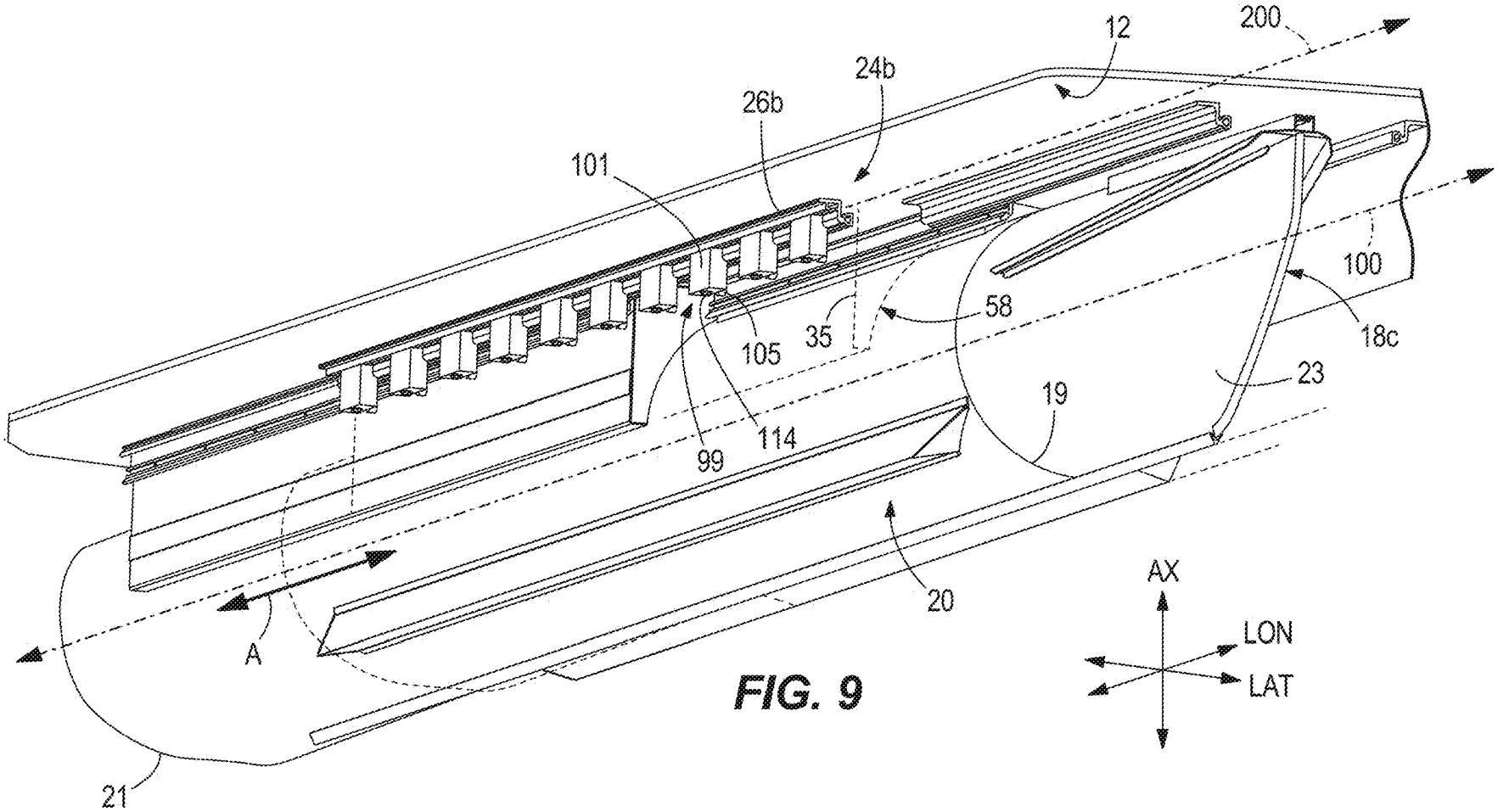
FIG. 9 is a perspective view showing the center pontoon, bracket assembly, and removal tool.

Referring to FIGS. 7-9, the bracket assembly 24 may further include one or more service tools 99 which is/are configured to facilitate sliding of the hanger bracket 28*b* relative to the base bracket 26*b* when the bracket assembly 24*a*, 24*b* is in the unlocked position. The service tools 99 are attachable to the base bracket 26*b* and engage with the hanger bracket 28*b* to lift the hanger bracket 28*b* relative to the base bracket 26*b*. The service tool 99 may alternately be configured to attach to the hanger bracket 28*b* and engage with the base bracket 26*b* to lift the hanger bracket 28*b* relative to the base bracket 26*b*.

As shown in FIGS. 7-8, the service tool 99 has a body 101 which is attached to the base bracket 26*b* via a fastener 114 and a roller 105 which engages with the hanger bracket 28*b*. The body 101 extends axially from a bottom face 106 to a top face 108. The body 101 has a first face 107 and a laterally opposed second face 109. A through-bore 113 extends from the bottom face 106 to the top face 108. The body 101 has a lifting divot 110 which extends downwardly from the top face 108 and inwardly from the second face 109. As shown in FIG. 8, the lifting divot 110 is shaped to accommodate the arm 34 and the elbow 39 of the base bracket 26*b*. The body 101 further has a dowel 112 which extends laterally from the second face 109 to an outer end 111.

The fastener 114 has a head 115 and shaft 116 which has a threaded end 117 opposite the head 115. The fastener 114 engages with a washer 118 which is positioned between the head 115 and the bottom face 106. The shaft 116 extends upwardly through the through-bore 113 and into the track 48 of the base bracket 26*b*. A nut 120 is positioned within the track 48 and engages with the threaded end 117 of the fastener 114 to securely attach the body 101 to the base bracket 26.

The roller 105 is positioned on the dowel 112 of the body 101. The roller 105 has an internal bearing 119 which facilitates rotation of the roller 105 on the dowel 112. A retaining ring 121 is fixed to the outer end 111 of the dowel 112 to prevent the roller 105 from detaching from the dowel 112.

In use, the bracket assembly 24*b* has a resting state in which the service tools 99 are not attached to the base bracket 26*b* and a rolling state (FIG. 8) in which the service tools 99 are attached to the base bracket 26*b*. In the resting state, the slide rail portion 50 of the hanger bracket 28*b* is engaged with the supporting rail 38 to support the hanger bracket 28*b* on the base bracket 26*b*. In the rolling state, the hanger bracket 28*b* is supported on the rollers 105, which facilitates longitudinal rolling of the hanger bracket 28*b* relative to the base bracket 26*b* along the slide axis 200, as shown via an arrow A in FIG. 9, and permits removal of the center pontoon 18*c* from the deck 12.

As shown in FIGS. 7-8, the service tool 99 is engaged with the base bracket 26*b* and axially supports the hanger bracket 28*b* in the rolling state. The fastener 114 extends through the through-bore 113 of the body 101. The threaded end 117 of the fastener 114 is engaged with the nut 120 within the track 48 of the base bracket 26*b*. The lifting divot 110 is engaged with the elbow 39 of the base bracket 26*b*. The roller 105 is engaged with and axially supports the engagement ramp 69 of the hanger bracket 28*b*, such that the hanger bracket 28*b* is rollable along the slide axis 200 with respect to the base bracket 26*b*.

To move the bracket assembly 24*b* from the resting state to the rolling state, the service tools 99 are attached to the base bracket 26*b* via the fasteners 114. To attach the service tool 99, the body 101 of the service tool 99 aligned with the base bracket 26*b* so that the fastener 114 extending through the through-bore 113 aligns with the track 48, the divot aligns with the elbow 39, and the roller 105 aligns with the engagement ramp 69. The nut 120 is inserted into the track 48 and aligned with the fastener 114. The fastener 114 is then rotated in a first direction such that the threaded end 117 engages with the nut 120 within the track 48. The service tool 99 is then free to be slid longitudinally along the track 48 into a position to engage with the hanger bracket 28*b*, such that other service tools 99 may be attached.

The fastener 114 is further rotated, which moves the body 101 upwardly relative to the base bracket 26*b* so that the divot 110 engages with the elbow 39 and the roller 105 engages with the outer end 70 of the engagement ramp 69, which lifts the body 101 and the hanger bracket 28*b* relative to the hanger bracket 28*b*. The fastener 114 is rotated until the slide rail portion 50 of the hanger bracket 28*b* is disengaged from the supporting rail 38, such that the hanger bracket 28*b* is fully supported on the roller 105.

To move the bracket assembly 24*b* from the rolling state back to the resting state, the service tools 99 are detached from the base bracket 26*b*. To remove the service tool 99, the fastener 114 is rotated in a second direction opposite the first direction, which moves the body 101 downwardly relative to the base bracket 26*b* until the body 101 and the roller 105 disengage from the hanger bracket 28*b*, and the slide rail portion 50 of the hanger bracket 28*b* engages with the supporting rail 38 of the base bracket 26.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A pontoon boat comprising:

a deck;

a pontoon configured to float and thereby support the deck above a body of water; and a bracket assembly that couples the pontoon to the deck, the bracket assembly comprising a base bracket that is fixedly coupled to the deck and a hanger bracket that hangs the pontoon from the base bracket;

wherein the bracket assembly has a locked position in which the hanger bracket is fixed to the base bracket and an unlocked position in which the hanger bracket is slidable relative to the base bracket to facilitate removal of the pontoon from the deck.

2. The pontoon boat according to claim 1, wherein the pontoon is elongated along a pontoon axis and wherein in the unlocked position the hanger bracket is slidable parallel to the pontoon axis.

3. The pontoon boat according to claim 1, wherein the base bracket comprises a supporting rail and wherein the hanger bracket comprises a slide rail which is supported on the supporting rail.

4. The pontoon boat according to claim 3, wherein in the unlocked position the slide rail is slidable along the supporting rail.

5. The pontoon boat according to claim 1, wherein the bracket assembly further comprises a locking fastener which fastens the hanger bracket to the base bracket in the locked position.

6. The pontoon boat according to claim 5, wherein the locking fastener comprises a fastener ramp and wherein tightening the locking fastener causes the fastener ramp to cam the hanger bracket into a stronger fixed coupling with the base bracket.

7. The pontoon boat according to claim 5, wherein the base bracket comprises a supporting rail and wherein the hanger bracket comprises a slide rail which is supported on the supporting rail, and wherein tightening the locking fastener cams the hanger bracket into a stronger fixed coupling with the base bracket.

8. The pontoon boat according to claim 7, wherein the locking fastener comprises fastener ramps that engage with corresponding ramps on the base bracket and the hanger bracket to cam the hanger bracket into said stronger fixed coupling.

9. The pontoon boat according to claim 1, wherein the bracket assembly further comprises a service tool that is attachable to the base bracket and/or hanger bracket, wherein attachment of the service tool to the base bracket and/or hanger bracket facilitates sliding of the hanger bracket relative to the base bracket in the unlocked position.

10. The pontoon boat according to claim 9, wherein attachment of the service tool to the bracket assembly lifts the hanger bracket relative to the base bracket to facilitate said sliding of the hanger bracket relative to the base bracket.

11. The pontoon boat according to claim 9, wherein the service tool has a roller configured such that attachment of the service tool to the bracket assembly facilitates rolling of the hanger bracket relative to the base bracket along said roller.

12. The pontoon boat according to claim 11, wherein attachment of the service tool to the bracket assembly causes the roller to lift the hanger bracket relative to the base bracket to facilitate said rolling of the hanger bracket relative to the base bracket along said roller.

13. The pontoon boat according to claim 9, wherein the service tool comprises a body and a fastener configured to fasten the body to the base bracket, and wherein tightening of the fastener lifts the body and the hanger bracket relative to the base bracket to facilitate said sliding of the hanger bracket relative to the base bracket.

14. The pontoon boat according to claim 9, wherein the service tool is one of a plurality of service tools having a plurality of rollers configured such that attachment of the plurality of service tools to the bracket assembly facilitates rolling of the hanger bracket along the plurality of rollers.

15. A pontoon boat comprising:

a deck;

a pontoon configured to float the deck above a body of water; and a bracket assembly that couples the pontoon to the deck, the bracket assembly comprising a base bracket that is fixedly coupled to the deck, a hanger bracket that hangs the pontoon from the base bracket, and a locking fastener having a locked position in which the hanger bracket is fixed to the base bracket and an unlocked position in which the hanger bracket is slidable relative to the base bracket to facilitate removal of the pontoon from the deck.

16. The pontoon boat according to claim 15, further comprising a service tool that is attachable to the bracket assembly, wherein attachment of the service tool to the bracket assembly facilitates sliding of the hanger bracket relative to the base bracket in the unlocked position.

17. The pontoon boat according to claim 16, wherein attachment of the service tool to the bracket assembly lifts the hanger bracket relative to the base bracket to facilitate said sliding of the hanger bracket relative to the base bracket.

18. The pontoon boat according to claim 16, wherein the service tool has a roller configured such that attachment of the service tool to the bracket assembly facilitates rolling of the hanger bracket relative to the base bracket along said roller.

19. A method of removing the pontoon from the pontoon boat according to claim 16, the method comprising attaching the service tool to the bracket assembly and removing the pontoon from the deck by sliding the hanger bracket relative to the base bracket.

20. An apparatus for coupling a pontoon to a deck of a pontoon boat, the apparatus comprising:

a base bracket that is fixedly coupled to the deck;

a hanger bracket that hangs the pontoon from the base bracket;

a locking fastener having a locked position in which the hanger bracket is fixed to the base bracket and an unlocked position in which the hanger bracket is slidable relative to the base bracket to facilitate removal of the pontoon from the deck; and a service tool that is attachable to the apparatus, wherein attachment of the service tool to the apparatus facilitates sliding of the hanger bracket relative to the base bracket in the unlocked position.

* * * * *